US006612412B2

(12) United States Patent
Sanderson et al.

(10) Patent No.: US 6,612,412 B2
(45) **Date of Patent: *Sep. 2, 2003**

(54) GOLF CLUB TRAVEL BAG

(75) Inventors: David B. Sanderson, Villa Park, CA (US); Teyrrie R. Garcia, Orange, CA (US)

(73) Assignee: SKB Corporation, Orange, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/027,730

(22) Filed: Dec. 19, 2001

(65) Prior Publication Data

US 2003/0111370 A1 Jun. 19, 2003

(51) Int. Cl.[7] ..... A45C 5/14; A63B 55/00; A63B 55/08

(52) U.S. Cl. ..... 190/18 A; 190/127; 150/159; 206/315.4; 206/315.5

(58) Field of Search ..... 150/159; 206/315.3–315.8; 190/125, 127, 18 A

(56) References Cited

U.S. PATENT DOCUMENTS

| | | | | |
|---|---|---|---|---|
| 4,951,818 | A | 8/1990 | Johnson | |
| 5,010,988 | A | * 4/1991 | Brown | 190/127 X |
| 5,265,894 | A | * 11/1993 | Dunn | 150/159 X |
| 5,515,897 | A | 5/1996 | Fehan | |
| 5,551,561 | A | * 9/1996 | MacRae et al. | 206/315.3 |
| D398,149 | S | 9/1998 | Sanderson et al. | |
| 5,810,064 | A | 9/1998 | Sanderson et al. | |
| 5,927,361 | A | 7/1999 | Sanderson et al. | |
| 6,161,698 | A | * 12/2000 | Bradshaw et al. | 150/159 X |
| 6,164,425 | A | * 12/2000 | Latshaw | 190/127 X |
| 6,401,890 | B1 | * 6/2002 | Tan | 150/159 X |

FOREIGN PATENT DOCUMENTS

| | | |
|---|---|---|
| JP | 58-14244 | 2/1983 |
| JP | 3006541 | 11/1994 |
| JP | 63-8067 | 1/1998 |

OTHER PUBLICATIONS

Internet Advertisement—Club Glove Travel Bags—Club Glove Last Bag Golf Travel Bag; Club Glove Last Bag XXL Golf Travel Bag; Club Glove Burst Proof Golf Travel Bag—2 pages—Undated.
Internet Advertisement—Club Glove Last Bag Golf Travel Bag; Club glove Last Bag XXL Golf Travel Bat; Club Glove Last Bag XXL; Club Glove Last Bag—4 pages—undated.
Internet Advertisement—West Coast Trends—Makers of the Original Club Glove—1 page—undated.
Internet Advertisement—Golfstore & Ladies Golf Clubs—Last Bag by Club Glove—2 pages—undated.
Internet Advertisement—Golfstore & Ladies Golf Clubs—Golf Travel Cases (with or without wheels)—1 page—undated.
Internet Advertisement—Goldstore & Ladies Golf Clubs—Golf Bag Trvel Covers—2 pages/undated.
Internet Advertisement—Golfstore & Ladies Golf Clubs—10" Deluxe Padded Travel Bag Cover—2 pages—undated.
Internet Advertisement—Golfstore & Ladies Golf Clubs—Last Bag by club glove—2 pages—undated.
Internet Advertisement—Golfstore & Ladies Golf Clubs—The Straight Jacket by OGIO—Golf Travel Cover—2 pages—undated.
Internet Advertisement—The Club Glove—The Ultimate in Travel Bag Sets—1 page—undated.
Advertisement from Golfsmith Catalog—1 page (p. 35)–undated.

* cited by examiner

*Primary Examiner*—Sue A. Weaver
(74) *Attorney, Agent, or Firm*—Orrick, Herrington & Sutcliffe, LLP

(57) ABSTRACT

A golf club travel bag comprising a generally parallelpiped shaped bag body having top, bottom, side, front and back panels preferably formed from foam padding interposed in a knit backing and a ballistic nylon shell. An inset shoe case recesses into the travel bag from the front panel to maintain a substantially streamline outer surface. The top and back of the bag include rigid plastic panels to provide further protection to the golf clubs therein without adding substantial weight to the bag.

9 Claims, 3 Drawing Sheets

GOLF CLUB TRAVEL BAG

This invention relates to golf bags and, more particularly, to a golf club travel bag that facilitates the transportation of gold clubs and accessories.

BACKGROUND OF THE INVENTION

A variety of golf club travel bags are known in the art. The travel bags range from thin nylon shells to hard cover cases. The thin nylon shell bags are desirable because they are light weight and easy to use. However, many of the thin nylon shell bags provide little, if any, protection for the golf clubs. The hard shell cases, on the other hand, provide a great deal of protection for the clubs. In addition, the hard shell cases are capable of carrying accessory items such as shoes. Although possessing many advantages, the hard shell cases are heavy and generally cumbersome to use and, thus, less desirable.

Soft or padded shell cases have grown in popularity due to their light weight construction and their ability to provide the golf clubs more protection than the nylon shell bags. Like the hard shell cases, the soft shell cases are also capable of carrying other items such as shoes. However, even these cases do not always provide sufficient protection to the clubs during airplane travel because of the manner in which such bags are handled by baggage handlers.

Therefore, it would be desirable to have a golf club travel bag that is relatively light weight, that provides sufficient protection for the golf clubs, that is capable of carrying additional items including golf shoes, and that is constructed in a manner to provide more protection for the clubs during rough handling and without adding significant weight to the bag.

SUMMARY OF THE INVENTION

The golf club travel bag of the present invention is a relatively light weight travel bag that provides sufficient protection for the golf clubs while being capable of carrying additional items including golf shoes and clothing, and being constructed in a manner that is less susceptible to tearing and damage to the clubs. It preferably comprises a generally parallelpiped shaped bag body formed from elongated front, rear, right and left side panels, and having a generally flat bottom portion and arcuate top portion. The panels preferably include a durable knit backing internal to the bag, a durable external shell constructed from ballistic nylon or the like, a layer of foam padding interposing the knit backing and the nylon shell, and several rigid plastic panels strategically located to provide more protection to the clubs. The bottom preferably includes one or more wheels to aid in rolling the bag, and the back preferably has skids to facilitate sliding the bag into a luggage compartment.

A zipper is sewn along an edge of the left side panel adjacent the front panel, and extends along the length of the bag around the top, side and bottom to expose the interior of the travel bag and allow a golf bag and a set of golf clubs to be placed inside of the travel bag. An inset shoe case is recessed into the travel bag from the front panel adjacent the top. A generally rectangular flap of the front panel operably covers the shoe case. The flap, which is integral With the front panel along the bottom of the flap, is connected to the front panel via a zipper. The zipper can be undone to provide access to the inset shoe case.

Importantly, the travel bag has several plastic panels strategically placed to provide protection to golf clubs, also, similar panels are included at the bottom and along a portion of the back as will be explained further later.

The inset shoe case is preferably located adjacent the top of the bag to prevent the shoe case from interfering with a golf bag stored therein. The location of the shoe case advantageously reduces jostling of the club heads, and resultant damage thereto, during transport.

The front also preferably includes to zipped compartments for clothes and other items.

An object of this invention is to provide an improved golf club travel bag.

Further objects and advantages of the present invention will become apparent from a consideration of the drawings and ensuing description.

DESCRIPTION OF THE PREFERRED EMBODIMENT

Figure 1:
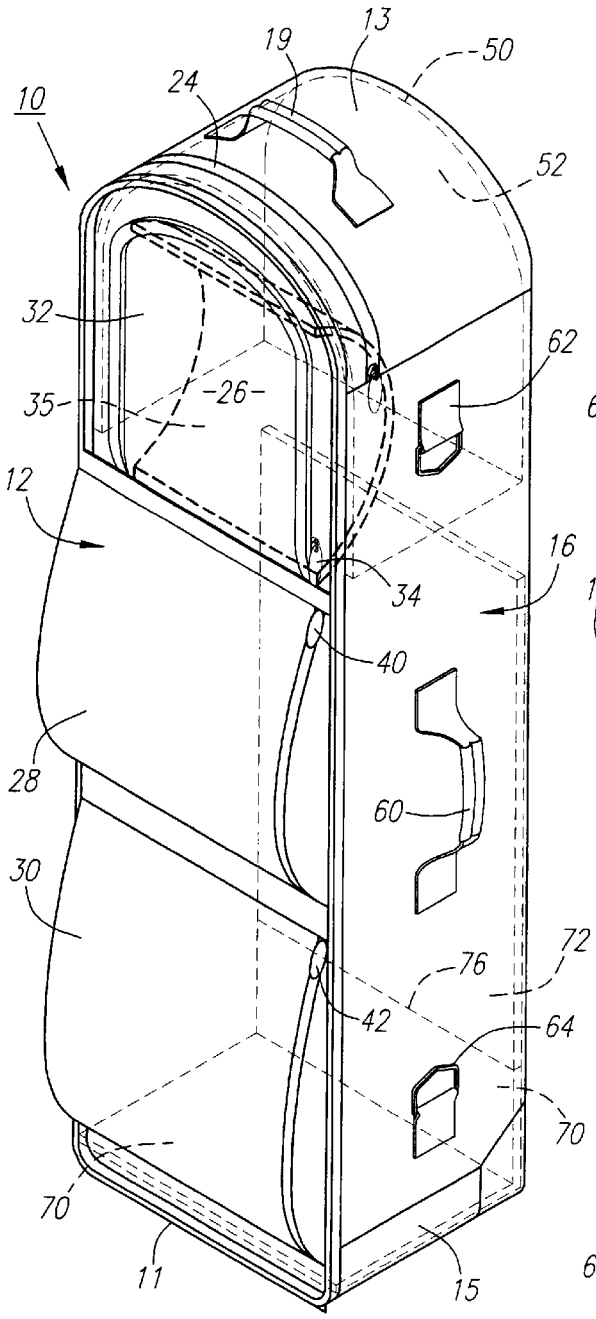
FIG. 1 is a perspective view of a golf club travel bag of the present invention.
Figure 2:
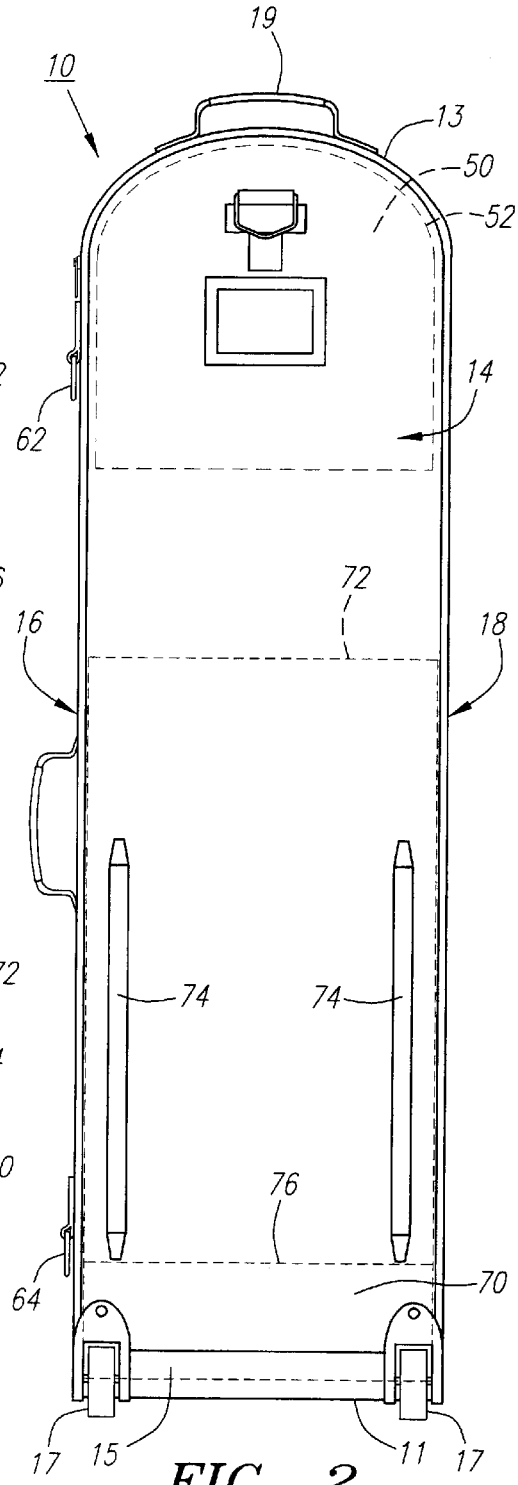
FIG. 2 is a back view of the golf club travel bag.

Turning now in detail to the drawings, a novel golf club travel bag 10 is shown. The travel bag 10 is a generally parallelpiped shaped bag body with elongated front, rear, left and right side panels 12, 14, 16 and 18. The panels 12, 14, 16 and 18 preferably comprise a durable knit backing, internal to the bag 10, a durable external shell constructed from ballistic nylon and a layer of foam padding interposing the knit backing and the nylon shell. Certain sections of the top area of the bag, and bottom and back, include plastic panels as will be described later.

The travel bag 10 includes a generally flat bottom 11, and the top portion 13 is arcuate. The bottom 11 includes a rigid cup-shaped member 15 preferably with wheels 17 to allow the travel bag to be rolled on the wheels while holding and moving the bag with a handle 19 affixed to the top 13. The member 15 preferably is 600 Denier vinyl.

Figure 3:
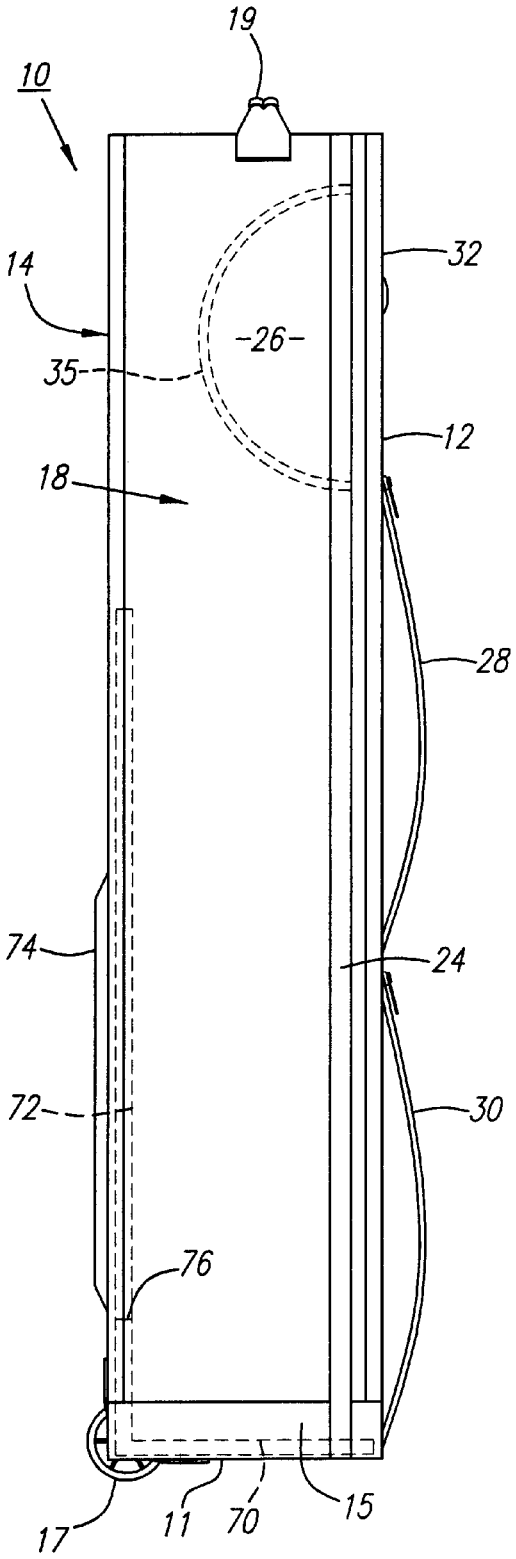
FIG. 3 is a left side view of the bag.
Figure 4:
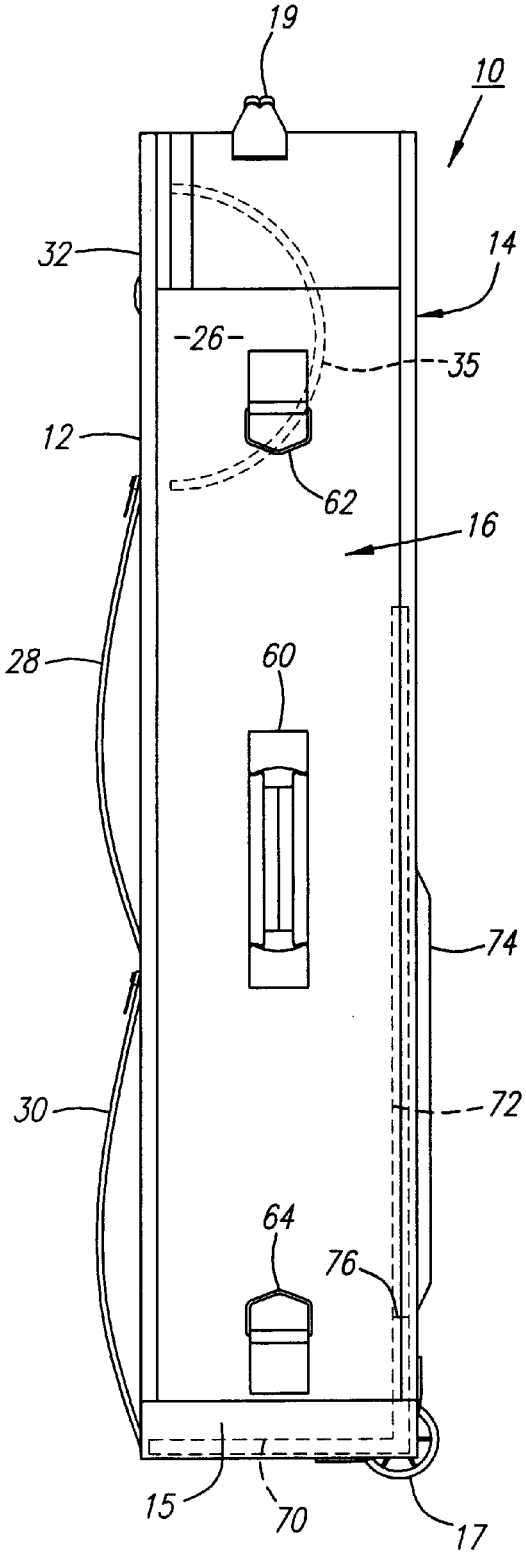
FIG. 4 is a right side view of the bag.
Figure 5:
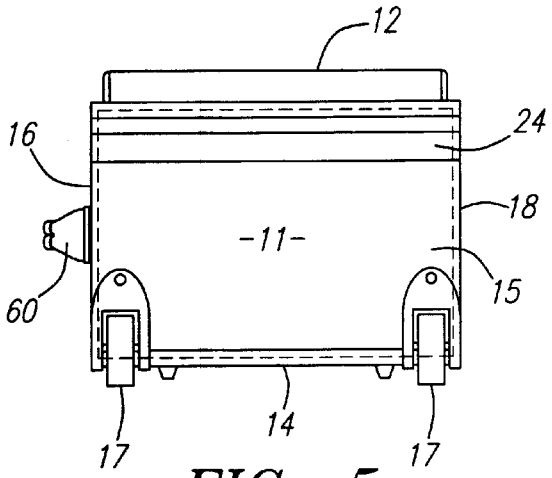
FIGS. 5 and 6 are respective bottom and top views.
Figure 6:
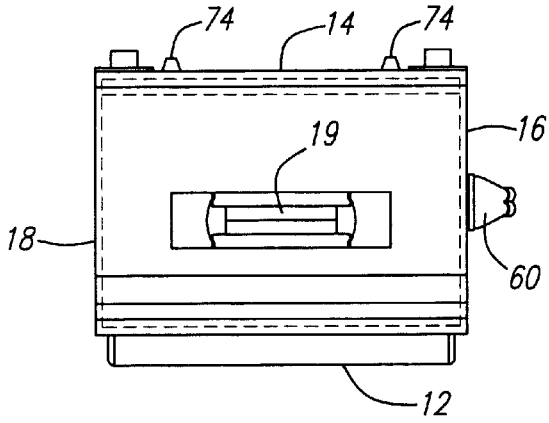

The entire front panel 12 can be opened like a door by undoing a zipper 24 which runs over the top 13 (FIG. 1), all along the left side 18 (FIG. 3) and across the bottom 11 (FIG. 5). This allows golf bag and clubs therein to be placed within the golf travel bag 10. The front 12 of the golf travel bag 10 includes three compartments 26, 28 and 30. Compartment 26 is designed to hold golf shoes, and includes a front flap 32 openable via a zipper 34. The shoe compartment 26 includes a rigid back panel 35 which is curved as seen in FIGS. 1, 3 and 4 in phantom, and the rigid panel serves as a spike guard. The compartment 26 provides sufficient space to store a pair of golf shoes while maintaining a relatively streamlined configuration of the bag.

Figure 8A:
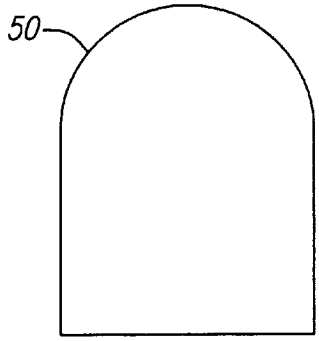
FIGS. 8*a*–8*c* are diagrams of rigid panels used in the bag.
Figure 8B:
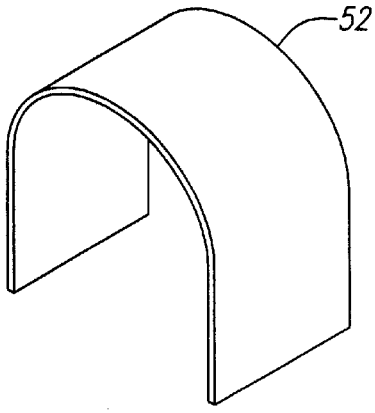
Figure 8C:
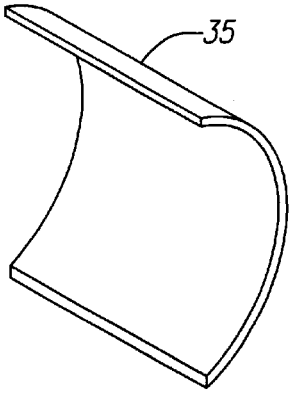

The compartments 28 and 30 preferably are for clothing and other items, and bulge slightly in a streamlined fashion as best seen in FIGS. 1, 3 and 4. Each is opened via a zipper 40 and 42 respectively. The shoe compartment 26 and holding compartments 28 and 30 provide sufficient protection or buffer areas from the front side 12 of the bag for the golf clubs and golf bag (not shown) disposed within the travel bag. The golf bag itself within the travel bag provides sufficient protection for the golf clubs except at the top of the travel bag. Accordingly, a flat rigid back panel 50 and a top arcuate rigid panel 52 as seen in FIGS. 8*a* and 8*b* are provided in the top area 13 of the travel bag 10. These panels, like the panel 35 in the shoe compartment 26, are formed of a suitable plastic such as rigid polypropylene plastic of approximately 1/16–1/8 inch thick, but can be any suitable thickness to provide the desired protection to the golf bag and clubs.

As noted earlier, the travel bag can be pulled via handle 19 on the top 13 on the wheels 17. Also, the bag can be carried via a handle 60. Also, a shoulder strap (not shown) can be attached to a pair of hooks 62 and 64.

The bottom of the travel bag includes an L-shaped plastic panel 70 which extends across the bottom 11 and partially up the back 14 side. A separate plastic panel 72 is provided as a back-up to runners or skids 74. A solid L-shaped panel could be provided in place of the separate panels 70 and 72, but it is desired that they be separated at 76 so that the bottom portion of the travel bag can be folded upwardly (when no golf bag or clubs are present) if desired.

Figure 7:
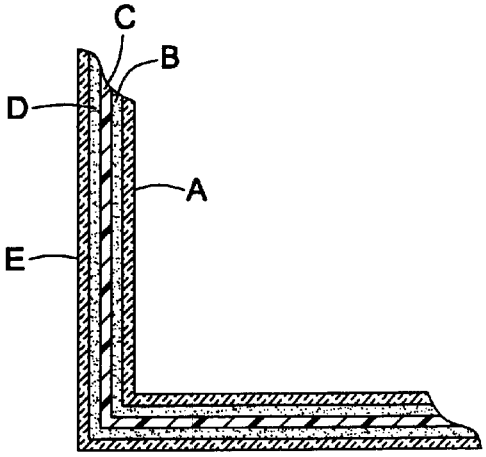
FIG. 7 is a cross-sectional view showing the laminated structure in the areas which include rigid panels.

FIG. 7 illustrates the laminate construction of the travel bag in the areas where the plastic panels C are disposed, wherein the inside layer A is Tricot material, then a layer of foam B, then the plastic panel C, another layer of foam D, and finally an outer layer of ballistic nylon. The sections of the travel bag without any of the plastic panels 50, 52, 70 or 72 comprise three layers of the Tricot material A, foam B and ballistic nylon E.

Thus, the golf club travel bag of the present invention provides many benefits over the prior art. While an embodiment of the present invention has been shown and described, various modifications may be made without departing from the scope of the present invention, and all such modifications and equivalents are intended to be covered.

What is claimed is:

1. A golf club travel bag comprising a flexible body with an inner region adapted to contain a golf bag with a set of golf clubs therein;

the bag having a front with an inwardly-extending inset shoe case continuing into the inner region from the outer surface, the inset shoe case being adjacent the top of the bag and having an inner back wall having a spike guard sufficiently hard to resist penetration of shoe spikes through the inner back wall, the front of the bag including at least one zippered compartment for containing clothes and the like, the bag having an arcuate top encompassing the shoe case, the top including an arcuate rigid plastic panel, and the bag having a back the top of which also includes a rigid plastic panel wherein the spike guard and plastic panels serve to further protect at least the heads of golf clubs adapted to be disposed within a golf bag within the golf club travel bag, the bag having a bottom with a rigid L-shaped bottom panel extending across the bottom and partially up the back of the bag, the bottom having wheels for facilitating rolling of the bag, and the back of the bag having a rigid plastic panel at least in the lower section thereof.

2. A golf club travel bag as in claim 1 including a handle attached to the top of the bag for facilitating rolling the travel bag via the wheels.

3. A golf travel bag as in claim 1 wherein the back of the bag has external skids for facilitating sliding of the travel bag into a luggage compartment of aircraft.

4. A golf travel bag as in claim 1 wherein the back further includes external skids adjoining the rigid panel in the lower section for facilitating sliding of the travel bag into a luggage compartment of aircraft.

5. A golf travel bag as in claim 4 wherein the top and bottom of the bag comprise a laminated structure having an inner layer of material, a foam layer, a rigid plastic panel, a foam layer and an outer material layer of ballistic nylon.

6. A golf travel bag as in claim 5 wherein the front of the bag includes two zippered compartments for containing clothes and the like.

7. A golf travel bag as in claim 1 wherein the rigid L-shaped bottom panel and the rigid plastic panel in the lower section of the back of the bag comprise two separate panels to allow the bag to be folded if desired at the intersection of these two panels.

8. A golf travel bag as in claim 7 further including external skids affixed to the bag adjoining the rigid panel in the lower section thereof for facilitating sliding of the travel bag into a luggage compartment of aircraft.

9. A golf travel bag comprising a body having an interior cavity adapted to contain and support a golf bag with a set of golf clubs within the golf bag, the bag having a front, back, right and left sides, a bottom and an arcuate top, the front of the travel bag having an inwardly-extending inset shoe case continuing into the upper portion of the cavity of the bag from the outer surface of the bag, the inset shoe case having an inner back wall having a rigid spike guard sufficiently hard to resist penetration of shoe spikes through the inner back wall, the arcuate top of the bag having laminated therein an arcuate rigid panel around the arcuate top, and a flat rigid panel in the upper portion of the back of the bag, these panels and the spike guard serving to further protect at least the heads of golf clubs adapted to be disposed within the travel bag, the bottom of the travel bag including laminated therein a rigid L-shaped bottom panel extending across the bottom and partially up the back of the bag, and the bottom having wheels for facilitating rolling the travel bag, the back of the travel bag having a rigid plastic panel at least in a lower section thereof, and the back further including external skids on the outside of the back of the bag adjacent the rigid plastic panel in the back for facilitating sliding of the travel bag into a luggage compartment of aircraft or the like, an upper portion of the arcuate top of the travel bag including handle for assisting in facilitating rolling the bag via the wheels, the front of the travel bag further including a plurality of zippered compartments for containing clothes or the like, and the bag including in the area thereof containing the rigid panels, a laminated structure comprising in sequence from the inside to the outside, a woven material, foam, the rigid panel, foam, and woven material, and the travel bag elsewhere where the rigid panels are not located comprising foam padding interposed between the material layers.

* * * * *